US005354388A

United States Patent [19]

Nojiri et al.

[11] Patent Number: 5,354,388

[45] Date of Patent: Oct. 11, 1994

[54] PRODUCTION OF BERYLLIUM-COPPER ALLOYS AND BERYLLIUM COPPER ALLOYS PRODUCED THEREBY

[75] Inventors: Keigo Nojiri; Takaharu Iwadachi, both of Handa, Japan

[73] Assignee: NGK Insulators, Ltd., Japan

[21] Appl. No.: 74,999

[22] Filed: Jun. 11, 1993

Related U.S. Application Data

[63] Continuation of Ser. No. 835,540, Feb. 14, 1992, abandoned.

[30] Foreign Application Priority Data

Feb. 21, 1991 [JP] Japan ..... 3-047475

[51] Int. Cl.[5] ..... C22C 9/00

[52] U.S. Cl. ..... 148/554; 148/682; 148/685; 148/432; 420/494

[58] Field of Search ..... 148/553, 554, 682, 685, 148/432; 420/494

[56] References Cited

U.S. PATENT DOCUMENTS

| | | | |
|---|---|---|---|
| 2,412,447 | 7/1942 | Donachie | 148/432 |
| 4,394,185 | 7/1983 | McClelland et al. | 148/554 |
| 4,425,168 | 1/1984 | Goldstein et al. | 148/554 |
| 4,466,939 | 8/1984 | Kim et al. | 148/554 |
| 4,565,586 | 1/1986 | Church et al. | 148/685 |
| 4,579,603 | 4/1986 | Woodard et al. | 148/554 |
| 4,724,013 | 2/1988 | Church et al. | 148/685 |
| 4,728,372 | 3/1988 | Caron et al. | 148/554 |
| 4,792,365 | 12/1988 | Matsui et al. | 148/554 |
| 4,931,105 | 6/1990 | Woodard | 148/554 |
| 5,074,922 | 12/1991 | Hiramitsu et al. | 148/554 |

FOREIGN PATENT DOCUMENTS

| | | | |
|---|---|---|---|
| 0271991 | 6/1988 | European Pat. Off. . | |
| 0282204 | 9/1988 | European Pat. Off. . | |
| 0390374 | 10/1990 | European Pat. Off. . | |
| 61-143564 | 7/1986 | Japan | 148/554 |
| 80/01169 | 6/1980 | World Int. Prop. O. . | |

*Primary Examiner*—Richard O. Dean
*Assistant Examiner*—Sikyin Ip
*Attorney, Agent, or Firm*—Parkhurst, Wendel & Rossi

[57] ABSTRACT

A process for producing the beryllium-copper alloy comprises the steps of casing a beryllium-copper alloy composed essentially of 1.00 to 2.00% by weight of Be, 0.18 to 0.35% by weight of Co, and the balance being Cu, rolling the cast beryllium-copper alloy, annealing the alloy at 500° to 800° C. for 2 to 10 hours, then cold rolling the annealed alloy at a reduction rate of not less than 40%, annealing the cold rolled alloy again at 500° to 800° C. for 2 to 10 hours, thereafter cold rolling the alloy to a desired thickness, and subjecting the annealed alloy to a final solid solution treatment. The beryllium-copper alloy obtained by this producing process is also disclosed, in which an average grain size is not more than 20 μm, and a natural logarithm of a coefficient of variation of the grain size is not more than 0.25.

8 Claims, 2 Drawing Sheets

PRODUCTION OF BERYLLIUM-COPPER ALLOYS AND BERYLLIUM COPPER ALLOYS PRODUCED THEREBY

This is a continuation of application Ser. No. 07/835,540 filed Feb. 14, 1992, now abandoned.

BACKGROUND OF THE INVENTION (1) Field of the Invention

The present invention relates to a process for producing beryllium-copper alloys having excellent mechanical strength, electric conductivity, reliability, etc. The invention also relates to beryllium-copper alloys produced by the above process.

(2) Related Art Statement

Beryllium-copper alloys composed mainly of Be and Cu have been widely used as as high strength spring materials, electrically conductive materials, etc. Beryllium-copper alloy is ordinarily converted to a thin sheet by conventional processes as shown in FIG. 2, for example. A beryllium-copper alloy having a given composition is cast, the cast beryllium-copper alloy is hot rolled, the hot rolled alloy is worked to a given dimension by subjecting it to annealing and cold rolling to remove work hardening, and finally, the cold rolled sheet is finished by solid solution treatment.

The annealing effected midway is carried out by strand annealings in which the alloy is recrystallized at high temperatures not lower than 800° C. for a short time period, and the alloy is subjected to the solid solution treatment to soften the alloy. Further, no conventional knowledge is available regarding the reduction rate in the cold rolling which is carried out between a plurality of intermediate annealing steps, and such a reduction rate has been merely set by expediency. The term "reduction rate" (%) equals (thickness before rolling—thickness after rolling)/(thickness before rolling)×100 with respect to the alloy.

However, the process for producing the beryllium-copper alloy shown by the flow chart in FIG. 2 has the following problems.

(1) Variations are likely to occur in alloy characteristics since the annealing is effected at high temperatures for a short time period and a recrystallization grain-growing speed is high. Therefore, since variations are likely to occur in the grain size and since the treatment is effected for a short time, a non-uniform texture after the hot rolling is difficult to eliminate.

(2) It is difficult to control the average crystalline grain diameter of the final product. This is because when the grain size is controlled to obtain desired characteristics, the grain size must be controlled only by the final solid solution treatment in the case of intermediate annealing effected at high temperatures.

(3) There is a high possibility that extremely duplex microstructure is produced. This is because when the temperature of the final solid solution treatment is controlled to increase the grain size, the temperature of the final solid solution treatment needs to be raised, which is likely to produce the duplex microstructure.

As discussed above, the conventional process has problems in a desired average grain size and grain size uniformity which greatly influence various characteristics, particularly, reliability. Accordingly, beryllium-copper alloys having excellent characteristics cannot be obtained.

SUMMARY OF THE INVENTION

It is an object of the present invention to solve the above-mentioned problems, and to provide a process for producing a beryllium-copper alloy, which produces an alloy product having uniform microstructure, small variations in alloy characteristics, and high reliability, whereby crystalline grain size can be easily controlled. The present invention also provides beryllium-copper alloys produced by this process.

The process for producing the beryllium-copper alloy according to the present invention is characterized by the steps of casting a beryllium-copper alloy composed essentially of 1.00 to 2.00% by weight of Be, 0.18 to 0.35% by weight of Co, and the balance being Cu, rolling the cast beryllium-copper alloy, annealing the alloy at 500° to 800° C. for 2 to 10 hours, then cold rolling the annealed alloy at a reduction rate not less than 40%, annealing the cold rolled alloy again, at 500° to 800° C. for 2 to 10 hours thereafter cold rolling the alloy to a desired thickness, and subjecting the annealed alloy to a final solid solution treatment.

The beryllium-copper alloy produced by the process according to the present invention is characterized in that the average grain size is not more than 20 μm, and a natural logarithm of a coefficient of variation of the crystalline grain size is not more than 0.25.

These and other objects, features and advantages of the invention will be appreciated upon reading of the following description of the invention when taken in conjunction with the attached drawings, with the understanding that some modifications, variations and changes of the same could be made by the skilled person in the art to which the invention pertains without departing from the spirit of the invention or the scope of claims appended hereto.

BRIEF DESCRIPTION OF THE DRAWINGS

For a better understanding of the invention, reference is made to the attached drawings, wherein.

DESCRIPTION OF THE PREFERRED EMBODIMENTS

Figure 1:
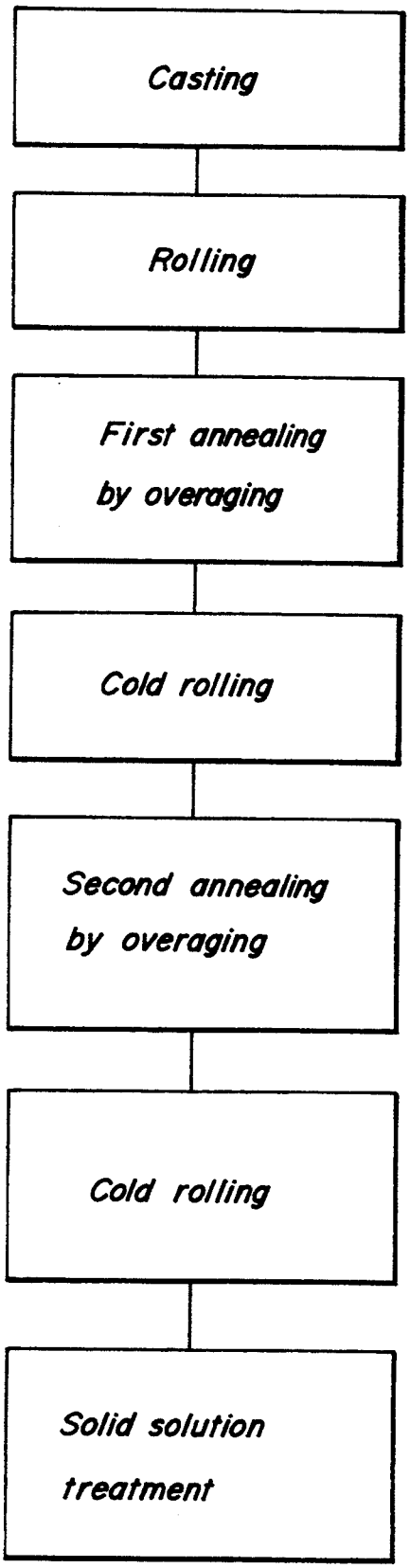
FIG. 1 is a flow chart of an example of the process for producing beryllium-copper alloy according to the present invention.
Figure 2:
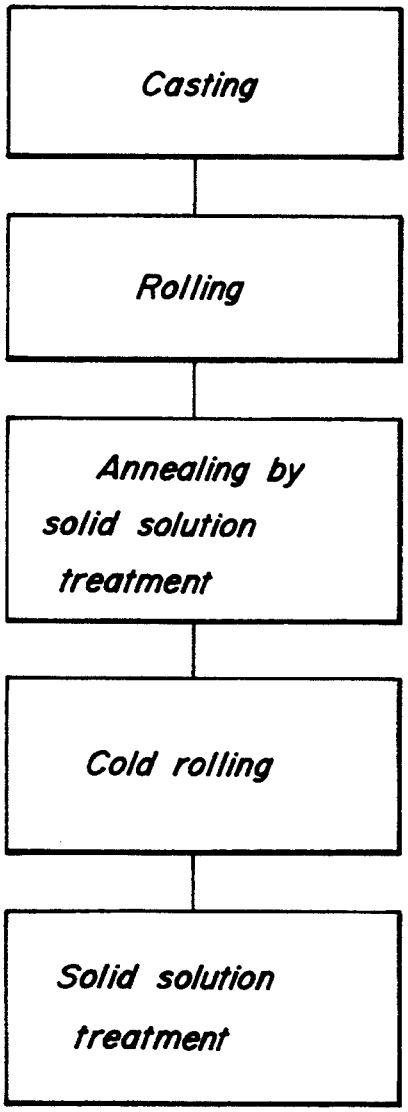
FIG. 2 PRIOR ART
FIG. 2 is a flow chart of an example of a conventional process for producing beryllium-copper alloy.

According to the above process of the present invention, a beryllium-copper alloy commercially available as a high strength beryllium-copper alloy and having an ordinary composition is annealed twice by using overaging. The desired final grain size after the final solid solution treatment can be attained by specifying the temperature and time of the annealings and the reduction rate of the cold rolling effected therebetween.

The mechanism for controlling the grain size according to the present invention will be explained. The microstructure of the alloy having undergone hot rolling is non-uniform in many cases, and the non-uniform microstructure remains even after the cold rolling and the conventional annealing by the solid solution treatment, following the hot rolling. In view of this, this non-uniformity can be considerably reduced by annealing the alloy for a long time as in the case of the present invention. When the annealed alloy is then cold rolled at a given reduction rate and then annealed again for a long time, the thus reduced non-uniformity is eliminated. By such a consecutive treatment, a uniform microstructure can be obtained after the final solid solution treatment, while preventing occurrence of duplex microstructure.

Further, the precipitate formed on annealing using the overaging according to the present invention plays an important role in controlling the average grain size. The beryllium-copper alloy having the specified composition according to the present invention has an aging region and a solid solution region below and above about 600° C., respectively. Therefore, when the annealing temperature is changed to be about 600° C. as a center, microstructure a having different precipitation states can be obtained. The alloy has broadly two different kinds of the precipitates. One of them is spherical precipitate formed around a CoBe compound as nuclei, and the other is an acicular precipitate. The latter acicular precipitate is easily solid solved at the final solid solution treatment, whereas the former spherical precipitate is not readily solid solved. Thus the spherical precipitate pins recrystallized grain boundaries. Accordingly, the grain size of the alloy can be controlled by the same solid solution treatment through controlling the amount and the grain size of the spherical precipitate. The precipitate can be controlled by adjusting the annealing temperature during overaging. The desired uniformity of the spherical precipitate, i.e., the desired uniformity of the microstructure, can be attained by not only both annealing steps but also by intermediate cold rolling at a given reduction rate.

Next, reasons for various limitations in the present invention will be explained. First, the reason why the composition is limited to 1.00 to 2.00% by weight Be, 0.18 to 0.35% by weight of Co and the balance being Cu is that this composition is the most industrially practical from the standpoint of the mechanical strength, electrical conductivity and economy. The reason why the annealing temperature is set at 500° to 800° C. is that if the temperature is less than 500° C., it is difficult to sufficiently recrystallize the alloy so that a non-uniform microstructure containing a non-recrystallized portion is produced, whereas if the temperature is more than 800° C., the crystalline grains greatly grow to make it difficult to control the grain size in the succeeding final solid solution treatment. Further, the reason why the annealing time is limited to 2 to 10 hours is that if the time is less than 2 hours, uniformity is insufficient, whereas if it is more than 10 hours, no further annealing effect can be obtained. Further uniformity can be desirably attained by setting the annealing time to not less than 4 hours. In addition, the reason why the reduction rate in the cold rolling is set to not less than 40% is that if the reduction rate is less than 40%, sufficient uniformity can not be attained in the second annealing. In order to further increase the uniformity, the reduction rate is preferably not less than 60%.

FIG. 1 is the flow chart illustrating an example of the process for producing the beryllium-copper alloy according to the present invention. As shown in FIG. 1, after a beryllium-copper alloy having a given composition is cast, the cast ingot is subjected to rolling consisting of hot rolling and cold rolling. Then, the alloy rolled to a desired thickness of, for example, 2.5 mm is subjected to a first annealing at 500° to 800° C. for not less than 2 hours. Then, after the thus annealed alloy is cold rolled at a reduction rate of not less than 40%, the alloy is annealed again under the same annealing conditions as those of the first annealing. Finally, after the resulting alloy is cold rolled to a desired thickness, the alloy is subjected to solid solution treatment to obtain the beryllium-copper alloy according to the present invention.

The present invention will be explained in more detail with reference to specific examples.

Examples and Comparative Examples

A beryllium-copper alloy composed essentially of 1.83% by weight of Be, 0.2% by weight of Co, and the balance being Cu was cast, and the cast ingot was hot rolled to obtain a hot rolled plate having a thickness of 7.6 mm. The hot rolled sheet was then cold rolled to a thickness of 2.3 mm. Next, the sheet thus cold rolled was subjected to a first annealing under annealing temperature and time conditions given in the following Table, and then cold rolled at a reduction rate also shown in Table 1 after the annealing. Then, the cold rolled sheet was subjected to a second annealing under annealing temperature and time conditions also given in Table 1. Finally, after the alloy was cold rolled to a thickness of 0.24 mm, it was subjected to the solid solution treatment at 800° C. for 1 minute.

A microstructure of each of the thus obtained alloy sheets falling inside and outside the scope of the present invention was photographed by an optical microscope. The degree of duplex representing the mean grain size and the spreading of the grain size distribution after the final solid solution treatment was determined by image analysis based on the photograph. The mixed grain size is a coefficient of variation assuming that a logarithm normal distribution is established. A small coefficient of variation represents a relatively uniform microstructure. Further, a R/t value as a bending characteristic and a hardness of the obtained alloy sheet were measured, and its coefficient of variation, CV, was determined to obtain variation degrees thereof. The coefficient of variation, CV, was determined according to $CV=\sigma/\bar{x}$ after obtaining an average value $\bar{x}$ and a standard deviation $\sigma$ with respect to 30 alloy sheets. Results are also shown in Table 1.

TABLE 1

| Run No. | | First annealing Temperature (°C.) | First annealing Time (hr) | Reduction at intermediate cold rolling (%) | Second annealing Temperature (°C.) | Second annealing Time (hr) | Mean grain size (μm) | Degree of duplex | CV Value of RH | CV Value of hardness |
|---|---|---|---|---|---|---|---|---|---|---|
| Examples in Present Invention | 1 | 500 | 10 | 76 | 500 | 6 | 12.5 | 0.175 | 0.009 | 0.020 |
| | 2 | 565 | 10 | 76 | 565 | 6 | 7.5 | 0.220 | 0.007 | 0.017 |
| | 3 | 700 | 6 | 40 | 565 | 6 | 7.0 | 0.222 | 0.007 | 0.018 |
| | 4 | 700 | 6 | 60 | 600 | 6 | 7.7 | 0.215 | 0.009 | 0.017 |
| | 5 | 700 | 6 | 40 | 630 | 4 | 8.2 | 0.220 | 0.013 | 0.023 |
| | 6 | 630 | 6 | 60 | 630 | 6 | 8.0 | 0.220 | 0.015 | 0.025 |
| | 7 | 700 | 4 | 76 | 700 | 6 | 12.0 | 0.183 | 0.011 | 0.020 |
| | 8 | 700 | 6 | 76 | 700 | 6 | 13.0 | 0.180 | 0.010 | 0.019 |

TABLE 1-continued

| Run No. | | First annealing Temperature (°C.) | First annealing Time (hr) | Reduction at intermediate cold rolling (%) | Second annealing Temperature (°C.) | Second annealing Time (hr) | Mean grain size (μm) | Degree of duplex | CV Value of RH | CV Value of hardness |
|---|---|---|---|---|---|---|---|---|---|---|
| | 9 | 800 | 4 | 60 | 565 | 6 | 7.0 | 0.210 | 0.006 | 0.017 |
| | 10 | 800 | 4 | 60 | 800 | 4 | 17.0 | 0.210 | 0.009 | 0.020 |
| Comparative Examples | 1 | 800 | 1 min. | 76 | 565 | 10 | 7.6 | 0.300 | 0.046 | 0.029 |
| | 2 | 800 | 1 min. | 76 | 830 | 1 min. | 15.0 | 0.275 | 0.050 | 0.020 |
| | 3 | 800 | 1 min. | 60 | — | — | 14.5 | 0.280 | 0.055 | 0.025 |
| | 4 | 500 | 10 | 60 | — | — | 12.0 | 0.190 | 0.030 | 0.020 |
| | 5 | 565 | 10 | 60 | — | — | 7.5 | 0.280 | 0.019 | 0.020 |

As is clear from the results in Table 1, the alloy sheets of the present invention which have undergone the first and second annealings and the intermediate cold rolling therebetween have a smaller grain size, a smaller degree of duplex, a smaller variations in the mechanical properties, and a more uniform microstructure as compared with Comparative Examples outside the scope of the present invention. Further, it is also clear from the results in Table 1 that the mean grain size can be controlled over a wide range by the producing process of the present invention. That is, when the formability is to be improved, the second annealing may be effected at about 560° C. On the other hand, when the strength before the final aging treatment is to be lowered, the second annealing may be effected at not less than 700° C.

As is clear from the above-mentioned explanation, according to the present invention, when the beryllium-copper alloy is subjected to the first and second annealings utilizing overaging under the specified annealing temperature, and is subjected to time and the intermediate cold rolling at the specified reduction rate between the first and second annealings grain size can be controlled to yield a beryllium-copper alloy having uniform microstructure. As a result, a highly reliable product can be obtained by removing variations in the mechanical properties.

What is claimed is:

1. A process for producing beryllium-copper alloy, consisting essentially of sequential steps of:

casting a beryllium-copper alloy composed essentially of 1.00 to 2.00% by weight of Be and 0.18 to 0.35% by weight of Co, the balance being Cu;

a first hot rolling of the alloy;

a first cold rolling of the alloy;

a first annealing of the alloy at 500° to 800° C. for 2 to 10 hours;

a second cold rolling of the beryllium-copper alloy at a reduction rate of not less than 40% to a thickness greater than a desired thickness;

a second annealing of the beryllium-copper alloy at 500° to 800° C. for 2 to 10 hours;

a third cold rolling of the beryllium-copper alloy to said desired thickness; and subjecting the beryllium-copper alloy to a final solid solution treatment.

2. The process of claim 1, wherein the steps of said first and second annealings are carried out for not less than 4 hours.

3. The process of claim 1, wherein said reduction rate of said first cold rolling is not less than 60%.

4. The process of claim 1, wherein a mean grain size of the beryllium-copper alloy obtained after said solid solution treatment is not more than 20 μm, and a natural logarithm of a coefficient of variation of the grain size is not more than 0.25.

5. A beryllium-copper alloy produced by the process of claim 1, wherein a mean grain size is not more than 20 μm, and a natural logarithm of a coefficient of variation of the grain size is not more than 0.25.

6. The process of claim 1, wherein said step of second cold rolling is carried out directly after said first annealing.

7. The process of claim 1, wherein said second annealing is carried out directly after said second cold rolling.

8. A process for producing beryllium-copper alloy having a mean grain size not more than 20 μm and a natural logarithm of a coefficient of variation of the grain size not more than 0.25, consisting essentially of sequential steps of:

casting a beryllium-copper alloy composed essentially of 1.00 to 2.00% by weight of Be and 0.18 to 0.35% by weight of Co, the balance being Cu;

a first hot rolling of the alloy;

a first cold rolling of the alloy;

a first annealing of the alloy at 500° to 800° C. for 2 to 10 hours;

a second cold rolling of the beryllium-copper alloy at a reduction rate of not less than 40% to a thickness greater than a desired thickness;

a third annealing of the beryllium-copper alloy at 500° to 800° C. for 2 to 10 hours;

a third cold rolling of the beryllium-copper alloy to said desired thickness; and subjecting the beryllium-copper alloy to a final solid solution treatment.

* * * * *